US010861358B2

(12) United States Patent
Kieser

(10) Patent No.: US 10,861,358 B2
(45) Date of Patent: Dec. 8, 2020

(54) WAISTBAND WITH A RETRACTABLE DISPLAY PANEL

(71) Applicant: Stephen Charles Kieser, La Honda, CA (US)

(72) Inventor: Stephen Charles Kieser, La Honda, CA (US)

( * ) Notice: Subject to any disclaimer, the term of this patent is extended or adjusted under 35 U.S.C. 154(b) by 13 days.

(21) Appl. No.: 16/351,541

(22) Filed: Mar. 13, 2019

(65) Prior Publication Data

US 2020/0294430 A1 Sep. 17, 2020

(51) Int. Cl.

| | |
|---|---|
| ***G09F 21/02*** | (2006.01) |
| ***A41F 9/00*** | (2006.01) |
| ***G09F 7/18*** | (2006.01) |

(52) U.S. Cl.

CPC ..... *G09F 21/026* (2013.01); *A41F 9/002* (2013.01); *G09F 7/18* (2013.01); *G09F 2007/1856* (2013.01); *G09F 2007/1886* (2013.01)

(58) Field of Classification Search

CPC ... A41F 9/00; A41F 9/002; G09F 7/18; G09F 2007/1856; G09F 2007/1886; G09F 21/02; G09F 21/023; G09F 21/026

(Continued)

(56) References Cited

U.S. PATENT DOCUMENTS 4,459,703 A * 7/1984 Kosmas ..... A41D 13/0537 2/338

4,698,854 A * 10/1987 Slimmon ..... A47K 10/02 2/338

(Continued)

*Primary Examiner* — Cassandra Davis

(74) *Attorney, Agent, or Firm* — McLean Law LLC; Kimberly McLean, Esq.

(57) ABSTRACT

A waistband with retractable display panel apparatus having a waistband, a display panel frame and a display panel. The waistband includes a first strap and a buckle. The first strap including a plurality of notches, wherein one of the plurality of notches connects to the buckle to allow the waistband to be worn around a wearer's waist. The display panel frame includes a second strap and a first attachment mechanism. The second strap includes a plurality of notches. The first attachment mechanism connects the second strap to the first strap, by attaching one or more of the plurality of notches located along a left side of the second strap to one or more of the plurality of notches located on a left side of the first strap and by attaching one or more of the plurality of notches located along a right side of the second strap to one or more of the plurality of notches located on a right side of the first strap. The second strap is affixed to the first strap at a location so that the second strap is extended along the backside of the waistband. The retractable display panel includes a panel and a second attachment mechanism. The panel includes a plurality of holes embedded on the top edge of the panel. Moreover, the panel includes one or more visual elements imprinted thereon. The second attachment mechanism connects the panel to the display panel frame by attaching one or more of the plurality of holes located on a left side of the top edge of the panel to one or more of the plurality of notches located on a left side of the second strap and by attaching one or more of the plurality of holes located on a right side of the top edge of the panel to one or more of the plurality of notches located on a right side of the second strap. The one or more visual elements imprinted on the panel are visible when the panel is deployed and the one or more visual elements imprinted on the panel are not visible when the panel is retracted.

18 Claims, 4 Drawing Sheets

(58) Field of Classification Search
USPC ..... 40/640, 329, 586; 2/311, 312, 338, 319, 2/46
See application file for complete search history.

(56) References Cited

U.S. PATENT DOCUMENTS

D302,626 S * 8/1989 Robinson, Jr. ..... D2/629
5,241,706 A * 9/1993 Netz ..... A41D 13/0537 2/267
5,299,324 A * 4/1994 Zinna ..... A41F 9/002 2/311
5,501,379 A * 3/1996 Munoz ..... A41F 9/002 224/240
5,581,815 A * 12/1996 Hans ..... A41D 13/0015 2/115
6,408,444 B1 * 6/2002 Zinna ..... A41F 9/002 2/312
8,356,737 B2 * 1/2013 Lessman ..... A45F 5/021 224/245
8,595,867 B1 * 12/2013 Zinna ..... A45C 13/123 2/244

* cited by examiner

WAISTBAND WITH A RETRACTABLE DISPLAY PANEL

FIELD OF THE INVENTION

Embodiments described herein generally relate to waistbands, and more particularly to a waistband with a retractable display panel.

BACKGROUND OF THE INVENTION

Oftentimes, people use banners, billboards, or signs to convey information to passers-by. The information could be advertisements, bringing awareness to a cause, celebratory expressions, humorous communications or many others. These techniques lack uniqueness and do not readily grab a passerby's attention. On the contrary, the act of mooning, which is an old and traditional method for making others laugh, immediately grabs an observer's attention merely because of the nature of the act. Mooning has been practiced for centuries in many parts of the world. The concept of mooning can be used as a unique form of communication, where instead of dropping one's pants, a display with words and/or images imprinted on it, could be pulled over one's derriere so that the words and/or images imprinted on the display could be visible to an observer. This is a new way to effectively grab the attention of passers-by ensuring that they will see the words and/or images imprinted on the display.

BRIEF DESCRIPTION OF THE DRAWINGS

The various advantages of the embodiments of the present disclosure will become apparent to one skilled in the art by reading the following specification and appended claims, and by referencing the following drawings, in which:

SUMMARY OF THE INVENTION

Figure 1:
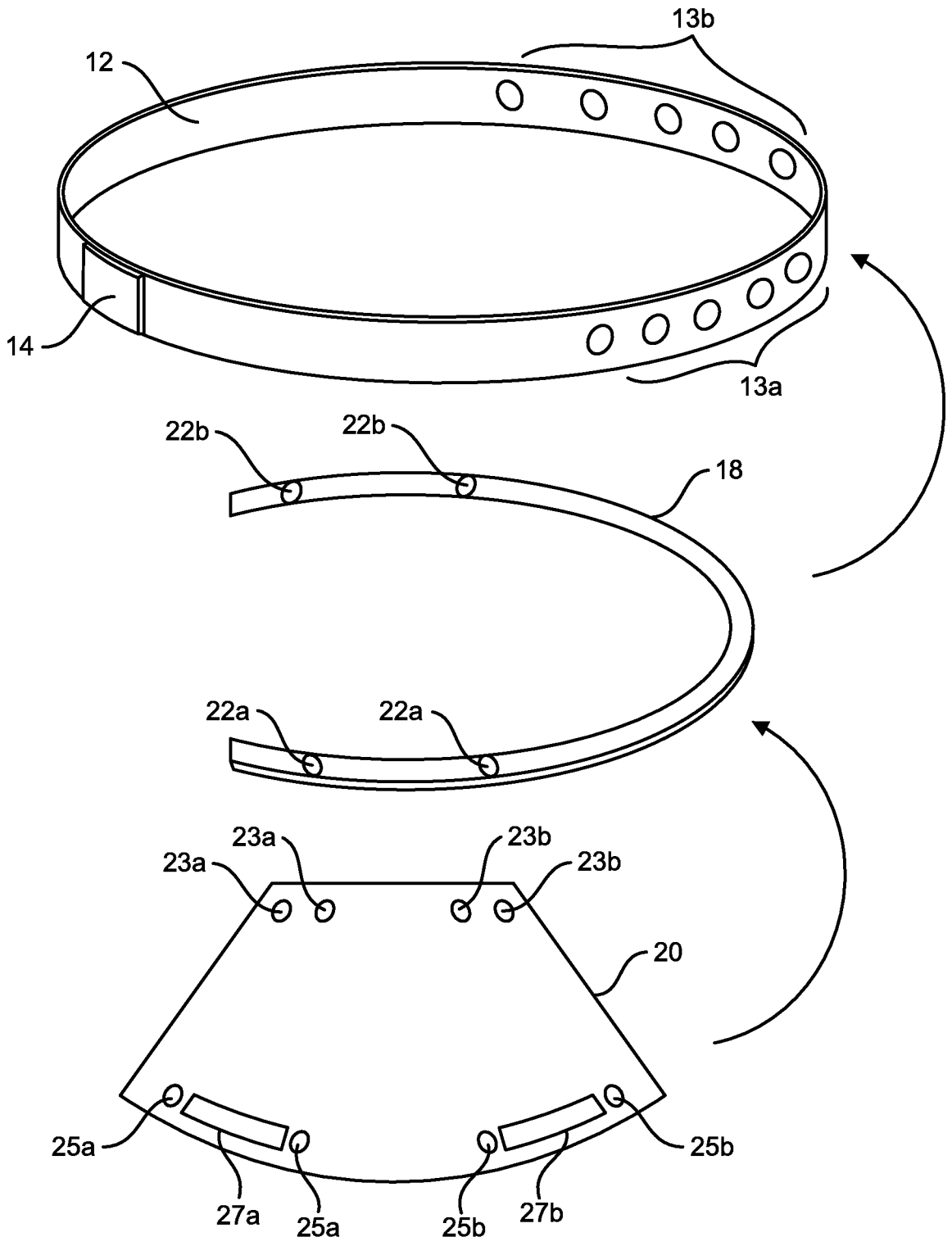
FIG. 1 shows an exemplary exploded view of a waistband with a retractable display panel according to an embodiment of the present disclosure.

Exemplary embodiments disclosed herein describe a waistband with retractable display panel apparatus having a waistband, a display panel frame and a display panel. The waistband includes a first strap and a buckle. The first strap including a plurality of notches, wherein one of the plurality of notches connects to the buckle to allow the waistband to be worn around a wearer's waist. The display panel frame includes a second strap and a first attachment mechanism. The second strap includes a plurality of notches. The first attachment mechanism connects the second strap to the first strap by attaching one or more of the plurality of notches located along a left side of the second strap to one or more of the plurality of notches located on a left side of the first strap and by attaching one or more of the plurality of notches located along a right side of the second strap to one or more of the plurality of notches located on a right side of the first strap. The second strap is affixed to the first strap at a location so that the second strap is extended along the backside of the waistband. The retractable display panel includes a panel and a second attachment mechanism. The panel includes a plurality of holes embedded on the top edge of the panel. Moreover, the panel includes one or more visual elements imprinted thereon. The second attachment mechanism connects the panel to the display panel frame by attaching one or more of the plurality of holes located on a left side of the top edge of the panel to one or more of the plurality of notches located on a left side of the second strap and by attaching one or more of the plurality of holes located on a right side of the top edge of the panel to one or more of the plurality of notches located on a right side of the second strap. The one or more visual elements imprinted on the panel are visible when the panel is deployed and the one or more visual elements imprinted on the panel are not visible when the panel is retracted.

In some exemplary embodiments, the panel includes a plurality of holes embedded on the bottom edge of the panel.

In some exemplary embodiments, the first attachment mechanism is a pair of bungee cords.

In some exemplary embodiments, the second attachment mechanism is a pair of bungee cords.

In some exemplary embodiments, the first and second attachment mechanisms are a same pair of bungee cords.

In some exemplary embodiments, the second attachment mechanism connects each side of the panel to each side of the display panel frame respectively by lacing a first bungee cord in a Z pattern through one or more of the plurality of notches located on a left side of the first strap, and one or more of the plurality of notches located on a left side of the second strap, and one or more of the plurality of holes located along a left side of the top of the panel and one or more of the plurality of holes located along a left side of the bottom of the panel, and by lacing a second bungee cord in a Z pattern through one or more plurality of notches located on a right side of the first strap, and one or more of the plurality of notches located on a right of the second strap, and one or more of the of the plurality of holes located along a right side of the top of the panel, and one or more of the plurality of holes located along a right side of the bottom of the panel.

In some exemplary embodiments, the panel is retractable using the pair of bungee cords.

In some exemplary embodiments, the panel includes one or more handle mechanisms for applying stress to the panel.

In some exemplary embodiments, the panel is deployed when manual stress is applied to the panel and the panel is retracted when the stress is removed.

In some exemplary embodiments, the deployed panel expands over the wearer's derriere.

In some exemplary embodiments, the panel is made of a stretch material that expands upon applied stress and retracts when the stress is removed.

In some exemplary embodiments, the width of the display panel is adjustable between wide and narrow.

In some exemplary embodiments, the panel includes a marker along the bottom edge of the panel.

In some exemplary embodiments, the marker includes a brand indicator.

In some exemplary embodiments, the display panel has an oval shape.

In some exemplary embodiments, the waistband is a belt.

In some exemplary embodiments, the buckle includes a brand indicator.

DETAILED DESCRIPTION

The present disclosure relates to a waistband with retractable display panel apparatus ("apparatus"). The apparatus provides an effective way of grabbing a passerby's attention ensuring that the passerby views the display panel when it is deployed. As illustrated in FIGS. 1-4, the apparatus 10 includes a waistband (includes References 12 and 14), a display panel frame (includes References 16 and 18), and a retractable display panel 20.

The waistband contains a first strap 12 and a buckle 14. The first strap includes a plurality of notches (i.e. holes) 13 (i.e., 13*a*, 13*b*) along the strap. The adjacent notches are located at an equal distance from one another. The buckle 14 is located at a center front location of the waistband and includes a frame and a prong for receiving one of the plurality of notches along the strap. The buckle attaches to the belt using any suitable fastener. In a preferred embodiment, the buckle attaches to the belt using button studs with screw backs. The first strap slides through the buckle to a desired width, and then the prong is inserted into one of the notches at the desired width. The first strap 12 is a strip of material that encircles an individual's waist. The waistband may be made of any suitable material. In a preferred embodiment, the waistband is a belt. In another exemplary embodiment, the waistband may include a snap or Velcro mechanism to adjust the width of the waistband. In a preferred embodiment, the buckle includes a design or brand indicator embedded therein.

The display panel frame includes a second strap 18 and a first attachment mechanism 16 (i.e., 16*a*, 16*b*). The second strap includes a plurality of notches 22 (i.e., 22*a*, 22*b*). The second strap may be made from any suitable material. In a preferred embodiment, the second strap is made from the same material as the first strap 12 and is cut from the first strap. The first strap may be made long enough to include a region for the waistband and to include a region for the display panel frame.

The first attachment mechanism 16 connects the second strap 18 to the first strap 12 by attaching one or more of the notches 22*a* located on a left side of the second strap to one or more of the notches 13*a* located on the left side of the first strap, and by attaching one or more of the notches 22*b* located on a right side of the second strap to one or more of the notches 13*b* located on a right side of the first strap. The second strap is affixed to the first strap at a location where the second strap is extended along the backside region 19 of the waistband.

The first attachment mechanism 16 may be any suitable mechanism for securely affixing the second strap 18 to the first strap 12. The first attachment mechanism 16 is inserted through one or more notches of the first and second straps to create a semi-permanent connection between the first and second straps. In a preferred embodiment, the first attachment mechanism is a pair of bungee cords (16*a*, 16*b*) that connect the first and second straps by lacing each cord through one or more notches of the first and second straps on a left side and right side respectively. Stopper knots 29 may be used, for example, to secure and reinforce the connection between the first strap 12 and the second strap 18.

In an alternative embodiment, the first attachment mechanism 16 is a plurality of button studs with screw backs. The button studs may be inserted through one or more notches of the first and second straps and the screw backs may be used on the backside of the studs to secure the connection between the first strap 12 and the second strap 18. Many other forms of first attachment mechanisms may be used such as, for example, snaps, Velcro, and buttons.

The retractable display panel includes a panel 20 and a second attachment mechanism 24 (i.e., 24*a*, 24*b*). The panel includes a plurality of holes 23 (i.e., 23*a*, 23*b*) located at the top of the panel and a plurality of holes 25 (i.e., 25*a*, 25*b*) located at the bottom of the panel. The second attachment mechanism may connect the panel to the display panel frame by attaching one or more of the plurality of holes 23*a* located along a left side of the top of the panel to one or more of the plurality of notches 22*a* located on a left side of the second strap 18 and by attaching one or more of the plurality of holes 23*b* located along a right side of the top of the panel to one or more of the plurality of notches 25*b* located on a right side of the second strap 18.

The second attachment mechanism 24 may be any suitable mechanism for securely affixing the panel 20 to the display panel frame by inserting the second attachment mechanism through one or more notches 22 of the second strap 18 and one or more holes 23 located at the top of the panel 20 to create a semi-permanent connection between the display panel frame and the panel. In another embodiment, the second attachment mechanism is inserted through one or more notches 22 of the second strap 18 and one or more holes located at the top 23 and bottom 25 of the panel to create a semi-permanent connection between the display panel frame and the panel.

Many forms of the second attachment mechanism 24 may be used, such as, for example, bungee cords, leather lacing cord, bubble-gum lacing cord, snaps, Velcro and buttons.

Figure 4:
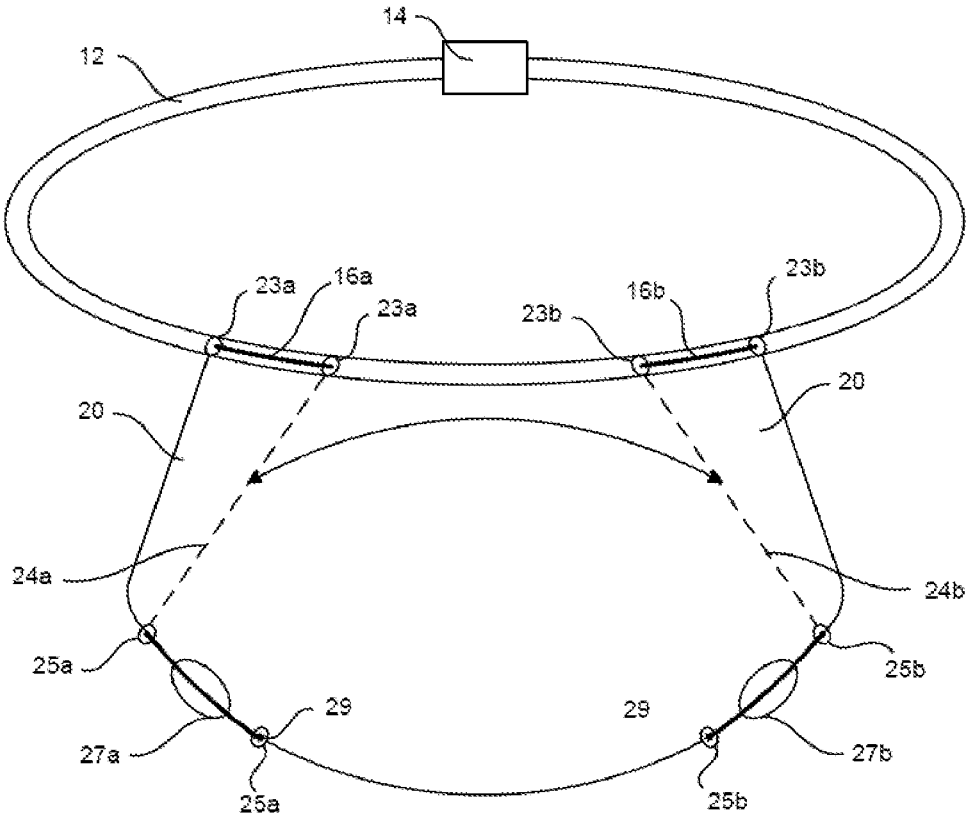
FIG. 4 shows an exemplary backside view of a waistband with a retractable display panel shown with the display panel in an unretracted position and with a Z pattern lacing according to an embodiment of the present disclosure.

In a preferred embodiment, the second attachment mechanism 24 connects each side of the panel to each side of the display panel frame respectively by lacing a first bungee cord 24*a* in a Z pattern through one or more of the plurality of notches 22*a* located on a left side of the second strap 18, and one or more of the plurality of holes 23*a* located along a left side of the top of the panel 20 and one or more of the plurality of holes 25*a* located along a left side of the bottom of the panel 20, and by lacing a second bungee cord 24*b* in a Z pattern through one or more of the plurality of notches 22*b* located on a right of the second strap 18, and one or more of the of the plurality of holes 23*b* located along a right side of the top of the panel 20, and one or more of the plurality of holes 25*b* located along a right side of the bottom of the panel 20, as illustrated in FIG. 4. The lacing through each side of the second strap 18 and the panel 20 are secured by stopper knots located at the beginning and end of the lace pattern.

In another alternative exemplary embodiment, the first attachment mechanism 16 may also be used as the second attachment mechanism 24. In this instance, the first attachment mechanism 16 connects each side of the panel to each side of the display panel frame respectively by lacing a first bungee cord 16*a* in a Z pattern through one or more of the plurality of holes 13*a* located along a left side of the first strap 12, and one or more of the plurality of notches 22*a* located along a left side of the second strap 18, and one or more of the plurality of holes 23*a* located along a left side of the top of the panel 20 and one or more of the plurality of holes 25*a* located along a left side of the bottom of the panel and by lacing a second bungee cord 16*b* in a Z pattern through one or more of the plurality of holes 13*b* located along a right side of the first strap 12, and one or more of the plurality of notches 22*b* located along a right side of the second strap 18, and one or more of the plurality of holes

23*b* located along a right side of the top of the panel 20 and one or more of the plurality of holes 25*b* located along a right side of the bottom of the panel. The lacing through each side of the first strap 12, second strap 18 and the panel 20 are secured by stopper knots located at the beginning an end of the lace pattern.

Figure 2:
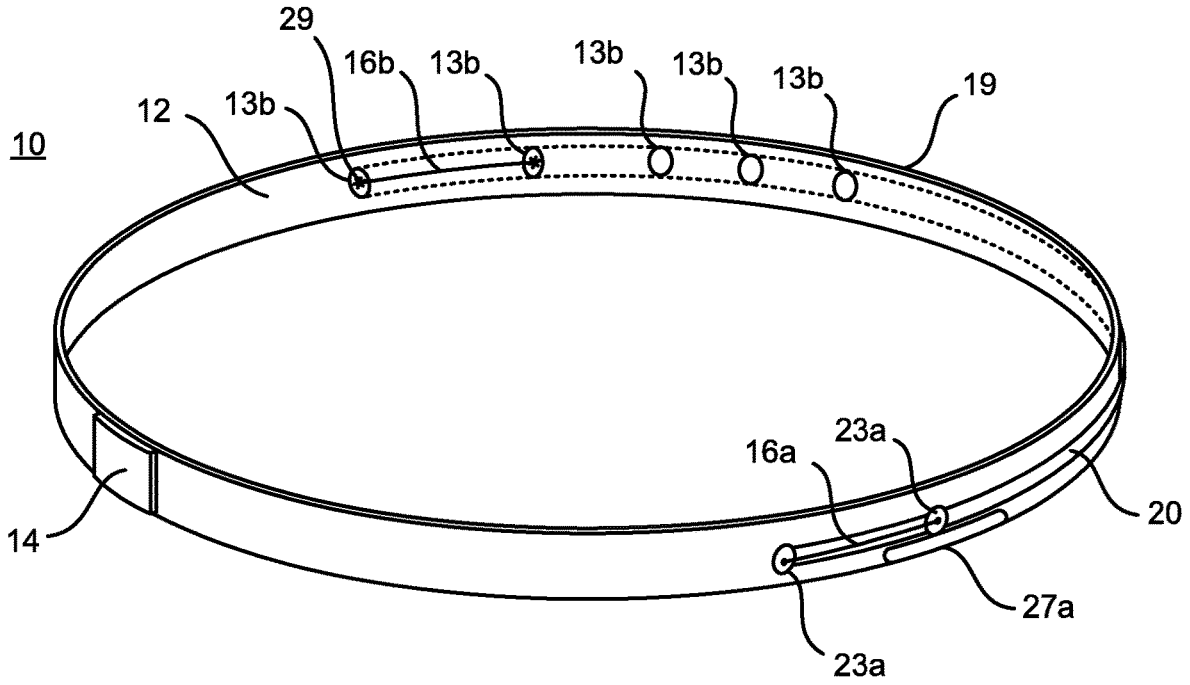
FIG. 2 shows an exemplary view of a waistband with a retractable display panel shown with the display panel in a retracted position according to an embodiment of the present disclosure
Figure 3:
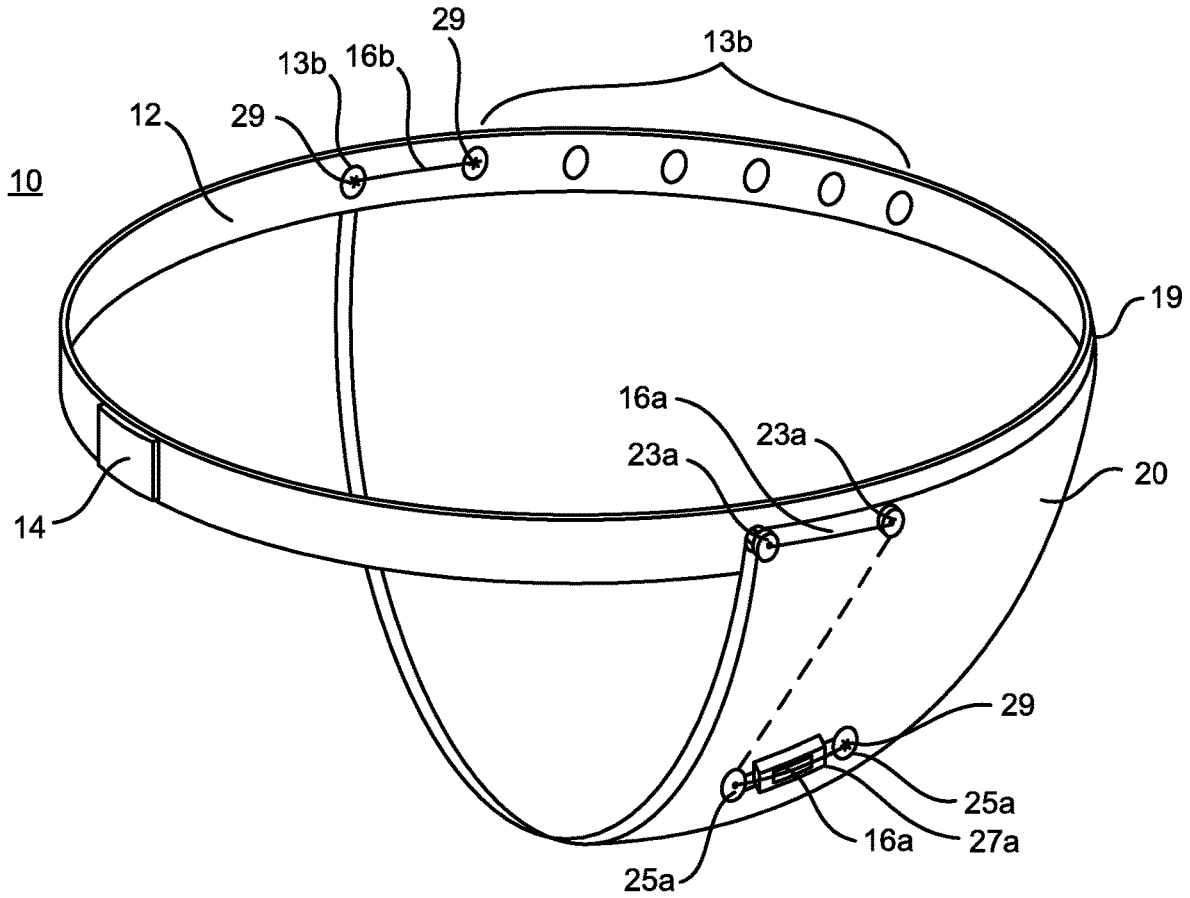
FIG. 3 shows an exemplary view of a waistband with a retractable display panel shown with the display panel in an unretracted position according to an embodiment of the present disclosure.

The panel 20 includes one or more visual elements imprinted on the panel. The one or more visual elements on the panel are visible when the display panel is deployed, as illustrated in FIGS. 3-4, and the one or more visual elements are not visible when the display panel is retracted, as illustrated in FIG. 2. The panel is deployed when stress is applied to the panel, and the panel is retracted when the stress is removed. The panel includes a handle mechanism 27 (i.e., 27*a*, 27*b*) on each side at the bottom end of the panel and stress is applied to the panel when the panel is pulled down by a wearer using the handle. The panel is originally connected to the display panel frame in a retracted state. The panel may be made from any suitable material. In a preferred embodiment, the panel is made from a material that stretches (expands) when stress is applied to the material, (e.g., by manually pulling the material), and that retracts to its original state when the stress is removed, such as, for example, elastic or spandex.

In a preferred embodiment, the panel 20 on the display panel frame is retracted using the pair of bungee cords where the first 16 and second attachment mechanisms 24 are a same pair of bungee cords. The pair of bungee cords have intrinsic retraction properties. So, when the wearer releases the handle mechanism, the pair of bungee cords automatically retract the panel back to its original state.

In another exemplary embodiment, the panel includes one or more fasteners, such as, for example, Velcro, located along the top region of the panel and the bottom region of the panel. The fasteners located along the top region of the panel mate with the fasteners located along the bottom region of the panel to close the panel to prevent viewing of the visual elements imprinted on the panel. The fasteners are used to retract the panel by folding the bottom of the panel up to the top of panel.

The panel 20 is connected to the second strap 18, which is located along the backside of the waistband 19. Thus, when the panel is deployed, the panel expands over the wearer's derriere. In operation, the wearer would moon observers by bending over and pulling down the panel 20 so that the observer could view the contents of the panel.

The width of the display panel is adjustable between wide and narrow. The width of the display panel is wide when the panel 20 connects to a pair of notches on the second strap 18 that are located a far distance from one another. Conversely, the width of the display panel is narrow when the panel 20 connects to a pair of notches on the second strap 18 that are located a close distance to one another.

The panel 20 includes a marker along the bottom edge of the panel. The marker may include a brand indicator designation. The panel may be of any size and shape. In a preferred embodiment, the panel is oval shaped.

The one or more visual elements on the display panel may be of any context, such as, for example, advertisements, raising awareness, political, celebratory expressions, humorous communications, etc. The one or more visual elements may include text or images. The images may include any images such as photos, logos, or texts.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.)

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A waistband with retractable display panel apparatus comprising:

a waistband containing a first strap and a buckle, the first strap including a plurality of notches, wherein one of the plurality of notches connects to the buckle to allow the waistband to be worn around a wearer's waist;

a display panel frame including a second strap and a first attachment mechanism, the second strap including a plurality of notches, the first attachment mechanism connecting the second strap to the first strap, by attaching one or more of the plurality of notches located along a left side of the second strap to one or more of the plurality of notches located on a left side of the first strap and by attaching one or more of the plurality of notches located along a right side of the second strap to one or more of the plurality of notches located on a right side of the first strap, the second strap is affixed to the first strap at a location so that the second strap is extended along the backside of the waistband; and a retractable display panel including a panel and a second attachment mechanism, the panel including a plurality of holes embedded on a top edge of the panel and including one or more visual elements imprinted thereon, the second attachment mechanism connecting the panel to the display panel frame by attaching one or more of the plurality of holes located on a left side of the top edge of the panel to one or more of the plurality of notches located on a left side of the second strap and by attaching one or more of the plurality of holes located on a right side of the top edge of the panel to one or more of the plurality of notches located on a right side of the second strap, and wherein the one or more visual elements imprinted on the panel are visible when the panel is deployed and the one or more visual elements imprinted on the panel are not visible when the panel is retracted.

2. The apparatus of claim 1, wherein the panel includes a plurality of holes embedded on a bottom edge of the panel.

3. The apparatus of claim 1, wherein the first attachment mechanism is a pair of bungee cords.

4. The apparatus of claim 1, wherein the second attachment mechanism is a pair of bungee cords.

5. The apparatus of claim 2, wherein the first attachment mechanism and the second attachment mechanism are a same pair of bungee cords.

6. The apparatus of claim 5, wherein the second attachment mechanism connects each side of the panel to each side of the display panel frame respectively by lacing a first bungee cord in a Z pattern through one or more of the plurality of notches located on a left side of the first strap, and one or more of the plurality of notches located on a left side of the second strap, and one or more of the plurality of holes located along a left side of the top of the panel and one or more of the plurality of holes located along a left side of the bottom of the panel, and by lacing a second bungee cord in a Z pattern through one or more of the plurality of notches located on a right side of the first strap, and one or more of the plurality of notches located on a right of the second strap, and one or more of the of the plurality of holes located along a right side of the top of the panel, and one or more of the plurality of holes located along a right side of the bottom of the panel.

7. The apparatus of claim 5, wherein the panel is retractable using the pair of bungee cords.

8. The apparatus of claim 1, wherein the panel includes one or more handle mechanisms for applying stress to the panel.

9. The apparatus of claim 1, wherein the panel is deployed when manual stress is applied to the panel and the panel is retracted when the stress is removed.

10. The apparatus of claim 1, wherein the deployed panel expands over the wearer's derriere.

11. The apparatus of claim 1, wherein the panel is made of a stretch material that expands upon applied stress and retracts when the stress is removed.

12. The apparatus of claim 1, wherein the width of the display panel is transitions between wide and narrow.

13. The apparatus of claim 1, wherein the panel includes a marker along a bottom edge of the panel.

14. The apparatus of claim 11, wherein a marker includes a brand indicator.

15. The apparatus of claim 1, wherein the display panel has an oval shape.

16. The apparatus of claim 1, wherein the retractable display panel is originally connected to the display panel frame in a retracted state.

17. The apparatus of claim 1, wherein the waistband is a belt.

18. The apparatus of claim 1, wherein the buckle includes a brand indicator.

* * * * *